US005305922A

United States Patent [19]

Varon

[11] Patent Number: 5,305,922

[45] Date of Patent: Apr. 26, 1994

[54] TOOTHPASTE DISPENSER

[76] Inventor: Chaim Varon, 14826 Magnolia Blvd., Sherman Oaks, Calif. 91403

[21] Appl. No.: 47,960

[22] Filed: Apr. 19, 1993

[51] Int. Cl.[5] ..... B65D 35/56

[52] U.S. Cl. ..... 222/105; 222/378; 222/379

[58] Field of Search ..... 222/95, 105, 321, 340, 222/378, 379, 380, 529

[56] References Cited

U.S. PATENT DOCUMENTS

T.993,004 4/1980 French ..... 222/321
2,620,943 12/1952 Critelli et al. ..... 222/379
4,174,056 11/1979 Loeffler ..... 222/321
4,583,668 4/1986 Maynard, Jr. ..... 222/529
4,826,052 5/1989 Micallef ..... 222/321
5,186,358 2/1993 McVay ..... 222/529

*Primary Examiner*—Gregory L. Huson
*Attorney, Agent, or Firm*—Roger Marrs

[57] ABSTRACT

A dispenser is disclosed herein having a paste container removably mounted in a stationary base with a dispensing nozzle for discharging paste therethrough. In one version, the paste container is pressurized by use of a removable air pump while in another version, a mechanical pump extracts paste into and through the nozzle. In either version, a brush-operated lever actuates a mechanism coupled to the nozzle for selectively releasing the pressurized paste.

3 Claims, 2 Drawing Sheets

TOOTHPASTE DISPENSER

BACKGROUND OF THE INVENTION

1. Field of the Invention

The present invention relates to the field of apparatus for dispensing a medicinal product, such as toothpaste or the like, by pressurizing the paste and discharging the paste via a lever-operated mechanism.

2. Brief Description of the Prior Art

In the past, it has been the conventional practice to dispense toothpaste from a tube by squeezing the tube, by using a rotary key, or by employing a sliding mechanism. In these instances, pressure is applied to the external tube and the pressure forces the paste through a nozzle for distribution onto a toothbrush. In other instances, elaborate mechanisms are provided for extracting the paste in selected amounts for the convenience of the user.

Problems and difficulties have been encountered with these prior systems, which stem largely from the fact that the pressure placed on the toothpaste is uneven and is not distributed in such a fashion to permit a smooth discharge of the paste from the tube. Also, the quantity of toothpaste being dispensed is sometimes inadequate or supplied in an abundance so that wastage is encountered. Furthermore, the dispensing of the pressurized toothpaste does not always index or register with the bristles of the toothbrush so that the quantity being dispensed sometimes drops or falls away from the bristle area upon which it is intended to rest.

Therefore, a long-standing need has existed to provide a novel toothpaste dispenser which includes means for pressurizing the supply of paste and which incorporates a lever mechanism operable by movement of the toothbrush itself to discharge and distribute a quantity of paste along the bristles of the brush. Such a device requires alignment of the brush with the dispensing nozzle and further requires a mechanism for evenly distributing a selected quantity of paste for discharge.

SUMMARY OF THE INVENTION

Accordingly, the above problems and difficulties are overcome by the present invention which provides a novel means for supplying toothpaste from a container, which includes a stationary housing in which the toothpaste container is located and which further includes a passageway in alignment with the nozzle of the tube so that the pressurized toothpaste can be introduced to a dispensing nozzle in direct alignment with the bristles of the toothbrush. A lever mechanism interconnects the toothbrush with the dispensing nozzle so that upon actuation, a limited supply of the pressurized paste is permitted to be discharged from the nozzle directly onto the aligned bristles of the brush. In this fashion, a pre-selected charge or amount of paste is dispensed and is placed directly on the bristles of the brush. Sealing means is applied for positively sealing the discharge nozzle from discharging paste unless actuated by the lever mechanism.

Therefore, it is among the primary objects of the present invention to provide a novel toothpaste dispensing mechanism which may discharge a given amount of past directly onto the bristles of a brush which is placed in registry or alignment with the discharged nozzle of the device.

Another object of the present invention is to provide a novel toothpaste dispensing mechanism employing a pivoting lever which is operated by the end of a bristled toothbrush whereby the bristles are in registry with the discharged nozzle so that a pre-selected quantity of paste is deposited directly onto the bristles.

Still a further object of the present invention is to provide a novel toothpaste dispensing device which selectively pressurizes the toothpaste in a tube so that upon actuation of an air pump or mechanical pump means, a selected quantity of the paste is discharged directly onto the brushing surface of the bristles carried by a conventional toothbrush.

Yet a further object of the present invention is to provide a novel and operable means for dispensing pressurized paste from a tube which employs a lever mechanism operable in combination with a nozzle means for discharging a selected quantity of the paste directly onto a receiving implement.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
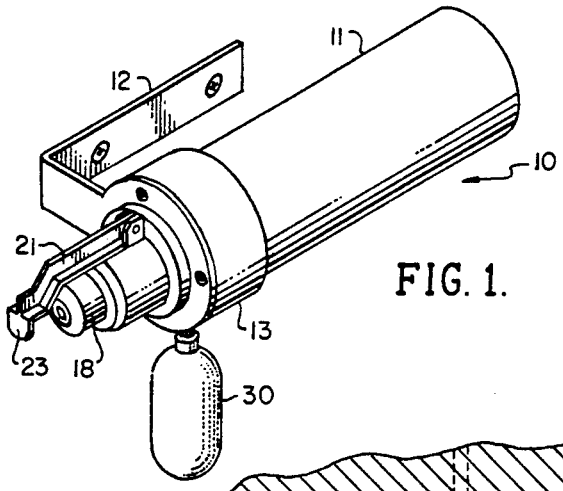
FIG. 1 is a front perspective view showing the novel toothpaste dispenser of the present invention.

Referring to FIG. 1, the novel toothpaste dispenser of the present invention is illustrated in the general direction of arrow 10 which includes a stationary container 11 held on a supporting structure by means of an L-shaped bracket 12 which includes a cylindrical collar 13 for releasably holding one end of the container 11. The container 11 encloses a tube of toothpaste, such as identified by numeral 14 in FIG. 2, in such a position that its outlet 15 is coaxially disposed with respect to a passageway 16 provided in the collar 13. The collar 13 further supports a fixed fixture 17 which is coaxially disposed about a movable nozzle 18 having a dispensing outlet 20 for discharging a quantity of toothpaste via the passageway 16 from the interior of the tube 14. The movable element 18 is actuated by means of a lever 21 when a toothpaste brush 22 is placed against an actuator element 23 and pushed upwardly so that the lever pivots about its pivot 24. A tooth 25 bears against the rear portion of element 18 which compresses a return spring 26 as the nozzle element 18 moves outwardly from the fixture 17. Such a position is shown with respect to FIG. 3 where the nozzle element 18 is fully advanced from the stationary fixture 17 and the spring 26 is fully contracted. When the toothbrush 22 is manually removed from the lever 21, the return spring 26 will expand causing the nozzle to return to the position shown in FIG. 2.

Figure 2:
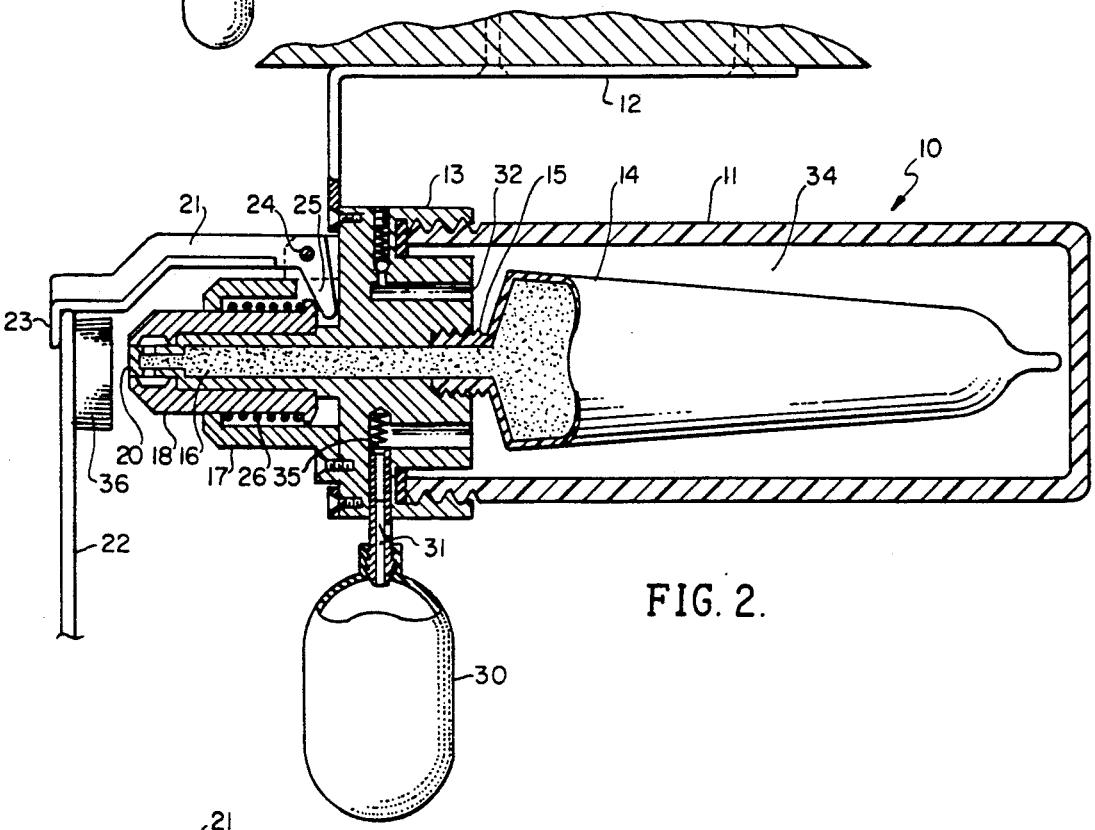
FIG. 2 is an enlarged longitudinal cross-sectional view of the dispenser shown in FIG. 1.

In order to pressurize the interior compartment of the container 11, FIG. 2 shows the temporary placement of a pressure bulb or pump 30 in position so as to pump air through a passageway 31 into an annular passage 32 for entrance into the inner compartment 33 of container 11. A check valve or one-way valve 35 ensures that no air will reverse through the passageways once enough air has been pumped into the interior compartment 34. At this time, the bulb 30 may be removed from the fixture and the device is ready for use.

Figure 3:
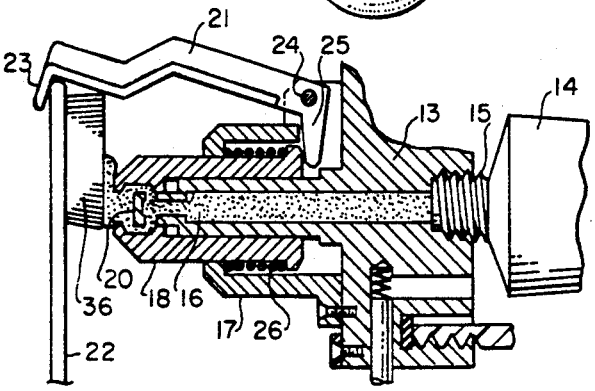
FIG. 3 is a fragmentary view similar to the view of FIG. 2 illustrating the nozzle mechanism of the dispenser in its open or operative position to dispense paste from the tube.

It can be seen in FIG. 3 that when the nozzle element 18 has been advanced, a clear passage exists for expelling paste through the nozzle and exterior of the nozzle element 18 so as to be spread over bristles 36 of the brush. In this fashion, the bristles are in registry with the discharge outlet and can easily collect the paste as it is dispensed. Therefore, there is no wastage nor is there any need for the user to align the bristles with a dispensing orifice.

Figure 4:
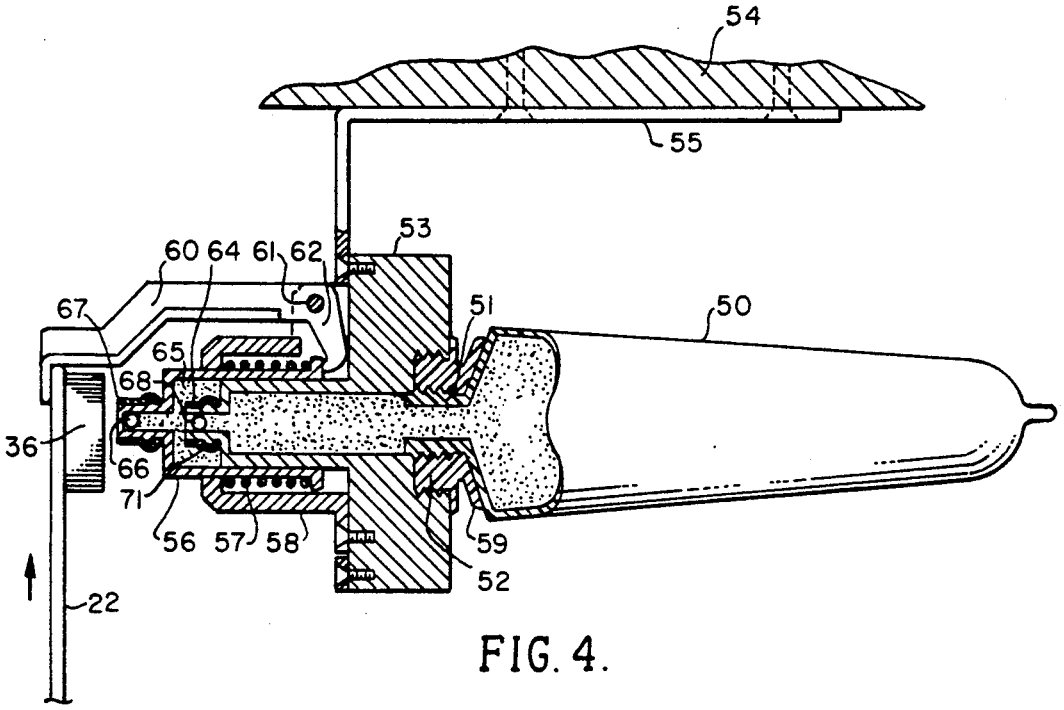
FIG. 4 is a longitudinal cross-sectional view similar to the view shown in FIG. 2 of another embodiment of the present invention.
Figure 5:
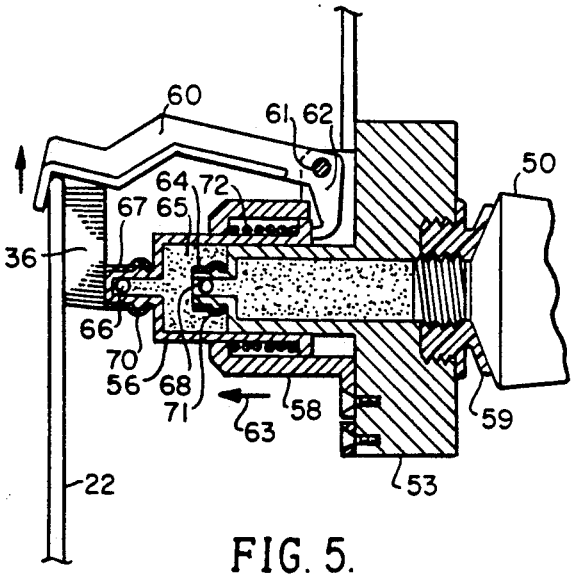
FIGS. 5 and 6 are fragmentary views of the second embodiment illustrated in its intermediate position and its final dispensing position.

Referring now in detail to FIGS. 4 and 5, another embodiment of the invention is illustrated wherein the tube filled with toothpaste is indicated by numeral 50 and it can be seen that the nozzle 51 of the tube is threadably engaged with an adaptor 52 taking the form of a soft deformable material which is carried on a collar 53. As the nozzle 51 is threaded into the deformable material of the adaptor 52, a sealing relationship takes place as well as a mounting relationship for the tube so that it is cantilevered outwardly from the collar 53. In this embodiment, the stationary container 11 is not needed since it is unnecessary to pressurize the toothpaste tube 50. The collar 53 is retained on a stationary support 54 by means of a bracket 55, such as that previously described.

In FIG. 4, a movable element 56 is illustrated in its relaxed position whereby the expansion of spring 57 urges the element 56 rearwardly towards the collar 53. Also, it can be seen, as previously described, that the movable element 56 is slidably mounted on a fixed fixture 58 outwardly projecting from the collar 53 from its side opposite to the side carrying the toothpaste tube 50. The toothpaste tube 50 is supported in position by an annular flange 59. A lever 60 operates about a pivot 61 so that hook 62 bears against the end of movable element 56 in order to move the element outward in the direction of arrow 63, as shown in FIG. 5.

Figure 6:
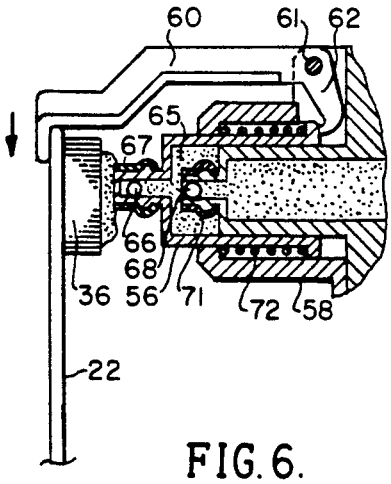

A double nozzle arrangement is illustrated wherein the first nozzle is indicated by numeral 64, which includes at least one aperture for expelling toothpaste from the tube into a dispensing chamber, indicated by numeral 65, preparatory for expulsion through a dispensing orifice 66 in the dispensing outlet 67. It is to be particularly noted that the aperture or orifice, indicated by numerals 66 and 68,.are covered by a resilient seal, such as indicated by numerals 70 and 71 respectively. The seals cover the dispensing apertures to retain the paste within the respective chambers. However, when the movable element 56 is moved outwardly in the direction of arrow 63, the paste is drawn through the aperture 68 to expand the rubber seal so that the paste may be expelled loaded into chamber 65. In other words, the moving of the movable element causes the paste to force its way through, by suction caused by the creation of a vacuum, the orifices 66 and 68 respectively so that it can be loaded in chamber 65 (FIG. 4) and discharged on the bristles 36 of the brush 22 (FIG. 6). A spring 62 similar to the spring previously described returns the element to the starting position, as shown in FIG. 6, and the respective seals return to cover the dispensing orifices.

In view of the foregoing, it can be seen that the two versions presented are improvements over the prior art and provide an advantageous means for dispensing of a paste from a tube or the like. It is to be understood that the paste may be medicinal in a variety of forms and that the tube may be pressurized, as shown in the embodiment in connection with FIGS. 1, 2 and 3, or unpressurized as shown in connection with the embodiment shown in FIGS. 4 and 5. The device is inexpensive to manufacture and is easy to use without the user having special skills or knowledge.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A toothpaste dispenser operated by one hand comprising:

a toothpaste tube holding a quantity of paste;

a stationary support retaining said tube in a fixed position;

said support having a fixture outwardly projecting from said support having a first nozzle in communication with said tube;

said fixture having a primary chamber in communication at one end with said paste held in said toothpaste tube and terminating in an interior wall carrying said first nozzle at said chamber's other end, a movable element slidably carried on said fixture having an exterior wall carrying a second nozzle coaxially disposed with respect to said first nozzle;

an intermediate chamber provided in said movable element defined between said fixture interior wall and said exterior wall for receiving paste from said first nozzle preparatory for dispensing from said second nozzle;

spring means compressed between said stationary support fixture and said movable element normally biasing said element away from said fixture;

flexible sealing means operable about each of said nozzles to release paste into said intermediate chamber and exteriorly of said second nozzle respectively in response to linear movement of said movable element;

said movable element having two positions defined as a first position compressing said spring means to load paste into said intermediate chamber and a second position expanded by said spring means to expel paste from said intermediate chamber exteriorly of and via said second nozzle;

a deformable adaptor composed of pliable material intercoupling said tube with said stationary support; and said firs position of said element creates a vacuum as it moves into its second position whereby paste is withdrawn via said fist nozzle past said sealing means to fill said intermediate chamber.

2. The invention as defined in claim 1 including:

manually operated lever means pivotally carried on said fixture and in engagement with said movable element to move said movable element into said first position.

3. The invention as defined in claim 2 wherein:

said lever means includes a hook in contact with said movable element and an extended arm having a terminating and adjacent to and in spaced relationship to said second nozzle whereby said movable element is responsive to pivot movement of said lever means when said arm terminating end is manually operated.

* * * * *